US007178280B1

(12) United States Patent
Passmore

(10) Patent No.: US 7,178,280 B1
(45) Date of Patent: Feb. 20, 2007

(54) VEHICLE MOUNTED DISPLAY

(76) Inventor: William Leonard Passmore, 918 Rocky Mount Rd. #1002, Athens, TN (US) 37303

( * ) Notice: Subject to any disclaimer, the term of this patent is extended or adjusted under 35 U.S.C. 154(b) by 246 days.

(21) Appl. No.: 10/838,620

(22) Filed: May 4, 2004

Related U.S. Application Data

(60) Provisional application No. 60/467,669, filed on May 5, 2003.

(51) Int. Cl.
*G09F 21/04* (2006.01)

(52) U.S. Cl. ..... 40/591; 116/173

(58) Field of Classification Search ..... 40/200, 40/209, 591, 607.13, 607.14, 666, 606.19; 116/173; 248/222.11, 229.26, 229.16
See application file for complete search history.

(56) References Cited

U.S. PATENT DOCUMENTS 2,620,579 A * 12/1952 Dienes ..... 40/591
3,357,662 A * 12/1967 Peterson ..... 248/513

* cited by examiner

*Primary Examiner*—Cassandra Davis
(74) *Attorney, Agent, or Firm*—Stephen J. Stark; Miller & Martin PLLC

(57) ABSTRACT

A display provides a frame having legs meeting at an upper end at a span. The lower ends of the legs terminate at feet which form a base and toes. The base and toes define a slot therebetween which cooperates with a leading edge of an access of one of a trunk of a vehicle, a tailgate of a trunk and a hatchback of a vehicle. The leading edge is received in the slot. A sign is supported by the frame and first and second shaft connectors receive a shaft having an ornament connected thereto, such as a flag or shaker.

9 Claims, 5 Drawing Sheets

VEHICLE MOUNTED DISPLAY

CLAIM OF PRIORITY

This application claims the benefit of U.S. Provisional Patent Application No. 60/467,669 filed May 5, 2003, and contains material provided to the U.S. Patent Office in Disclosure Document No. 531041 filed May 5, 2003.

BACKGROUND OF THE INVENTION

1. Field of the Invention

The present invention relates generally to a display for use with a vehicle, and more specifically to a sign and shaft holder retained to a vehicle along a hinged portion of the vehicle such as a trunk or a hatchback.

2. Description of Related Art

Various license plate holders have been designed to connect to a vehicle. Most are believed to connect to a front or rear bumper of a vehicle.

Various flag holders have been designed to connect to a vehicle by connecting to an upper edge of a window. The window is rolled at least partially down, the holder has a slot which fits over the upper edge of the window, and the window is rolled back up securing the holder to the vehicle. The holder receives a flag inserted therein. The problem with this configuration is that when the window is rolled down, whether intentionally, or unintentionally, while driving, the force of the wind can dislodge the holder thereby removing it from the vehicle. The Oriental Trading Co., Inc. sells IN-35/48 which has an American flag connected to such a holder and is called "Patriotic Car Flag w/Flag Holder". Other flags, such as those associated with team sports, are often supported by similar holders.

Improvements over these designs are believed to be necessary.

SUMMARY OF THE INVENTION

A need exists to provide an improved display for use with vehicles that connects to a hinged access.

Another need exists to provide an improved display supporting a sign, such as a license plate sized sign and/or flags.

Another need exists to provide a holder for use with vehicles with is unlikely to be dislodged while driving which supports at least one of a sign and an ornament having a shaft member such as a flag or shaker.

Accordingly, a vehicle mounted display according to the present invention provides a frame having legs meeting at an upper end at a span. The lower ends of the legs terminate at feet which form a base and toes. The base and toes define a slot therebetween which cooperates with a leading edge of an access of one of a trunk of a vehicle, a tailgate of a trunk and a hatchback of a vehicle. The leading edge is received in the slot. A sign is supported by the frame and first and second shaft connectors receive a shaft having an ornament connected thereto, such as a flag or shaker.

BRIEF SUMMARY OF THE DRAWINGS

The particular features and advantages of the invention as well as other objects will become apparent from the following description taken in connection with the accompanying drawings in which.

DETAILED DESCRIPTION OF THE DRAWINGS

Figure 1:
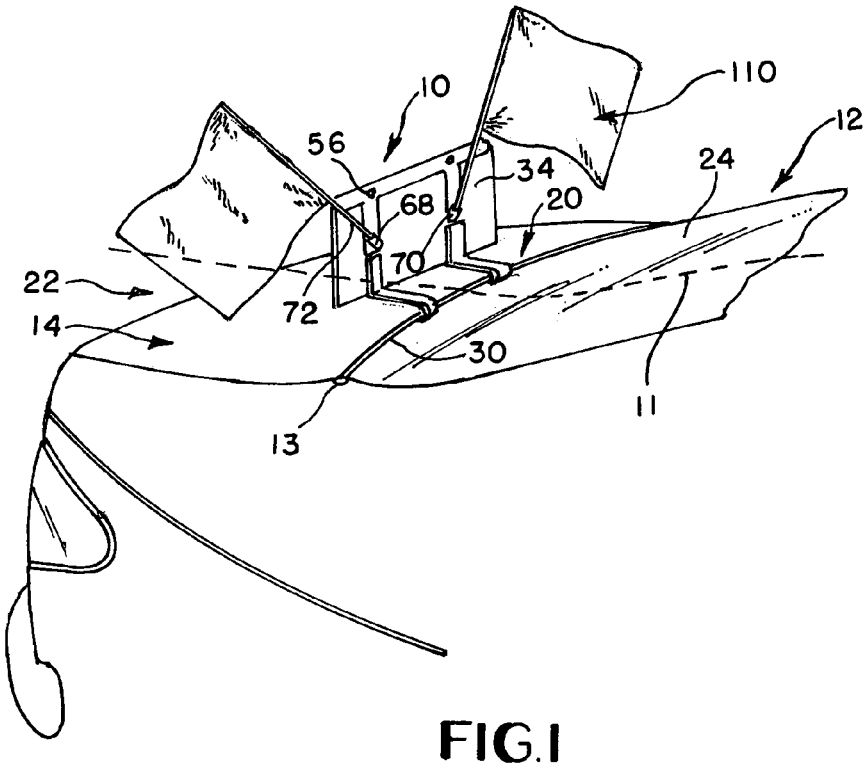
FIG. 1 is a top perspective view of a trunk of a vehicle with a display of the presently preferred embodiment installed.
Figure 2:
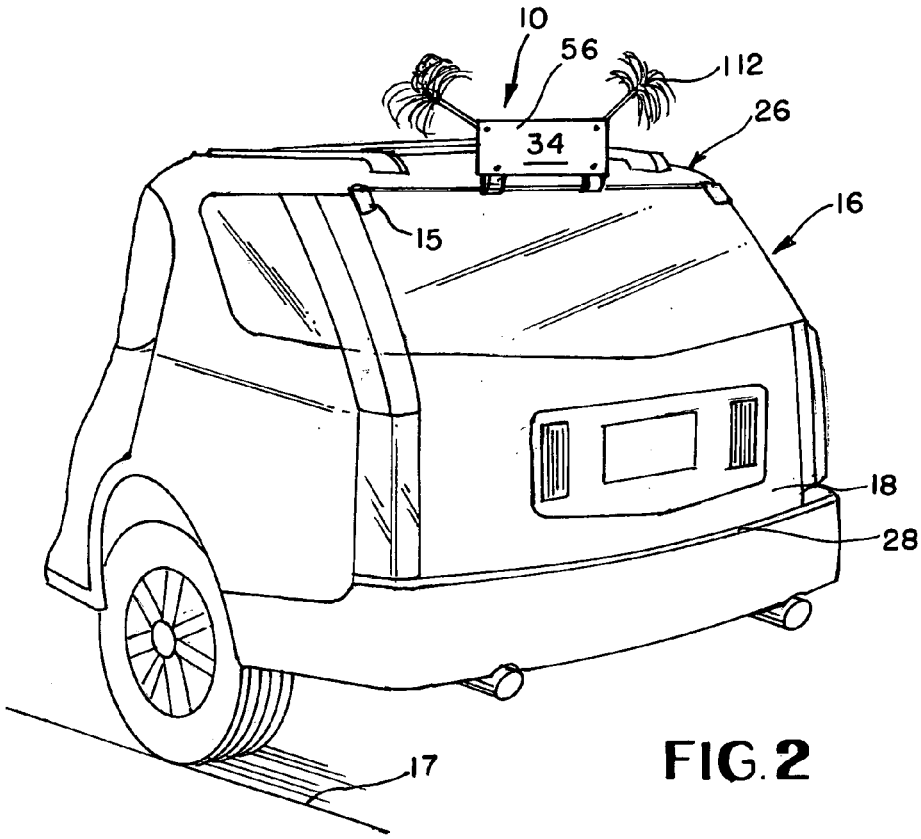
FIG. 2 shows a perspective side view of the display shown in FIG. 1 connected to a hatchback of a van.
Figure 12:
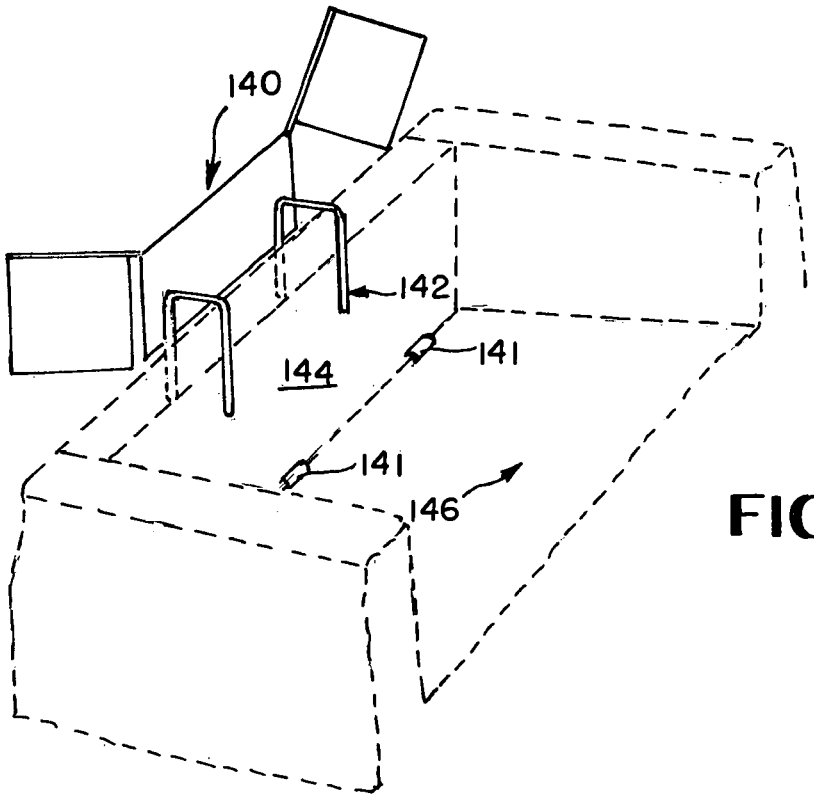
FIG. 12 is a top perspective view of a second alternatively preferred embodiment connected to a tailgate of a truck.
Figure 13:
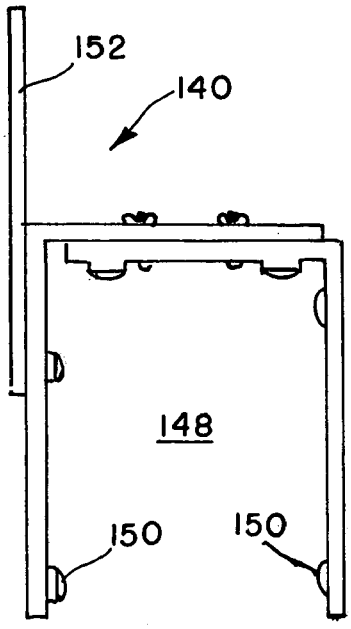
FIG. 13 is a side plan view of the second alternatively preferred embodiment shown in FIG. 12.

FIGS. 1–2 show a display 10 of the preferred embodiment installed on two vehicles: a car 12 having a trunk 14, in FIG. 1, and a SUV or van 16 having a hatchback 18, in FIG. 2. FIGS. 3–9 show the preferred construction of display 10. An embodiment for use with tailgates of trucks is shown in FIGS. 12 and 13.

FIG. 1 shows a display 10 connected to an access of a vehicle 12 at the trunk 14. The trunk 14 has a forward end 20 and a rearward end 22. The forward end 20 is located toward the passenger compartment 24, the rearward end 22 is normally located proximate to the rear of the vehicle 12. The front to back length axis 11 is shown in FIG. 1. Trunks 14 lift upwardly from their rearward end 22 when a latch, or lock (not shown) is released along the rearward end 22 to move upwardly. This allows access inside the trunk 14. The forward end 20 may move somewhat during this process. The operation of a trunk 14 will be understood by one of ordinary skill in the art.

The van 16 of FIG. 2 has a hatchback 18 instead of a trunk 14 as shown in FIG. 1. Other vehicles have hatchbacks 18 such as many sport utility vehicles (SUV's). Hatchbacks 18 normally have a top end 26 and a bottom end 28. The top end 26 is disposed above the bottom end 28. The display 10 is illustrated connected to the top end 26 of the hatchback 16. A leading edge 30 shown in FIG. 1 is present in the embodiment of FIG. 2, but obscured from view. The display connects to the leading edge 30 as will be described in further detail below. The leading edges 30 of trunks 14 and hatchbacks 18 are closer to hinges 13,15 than rearward ends 22 and bottom ends 28. The opposite of this is seen on truck tailgates as shown in FIG. 12 by hinges 141.

Figure 3:
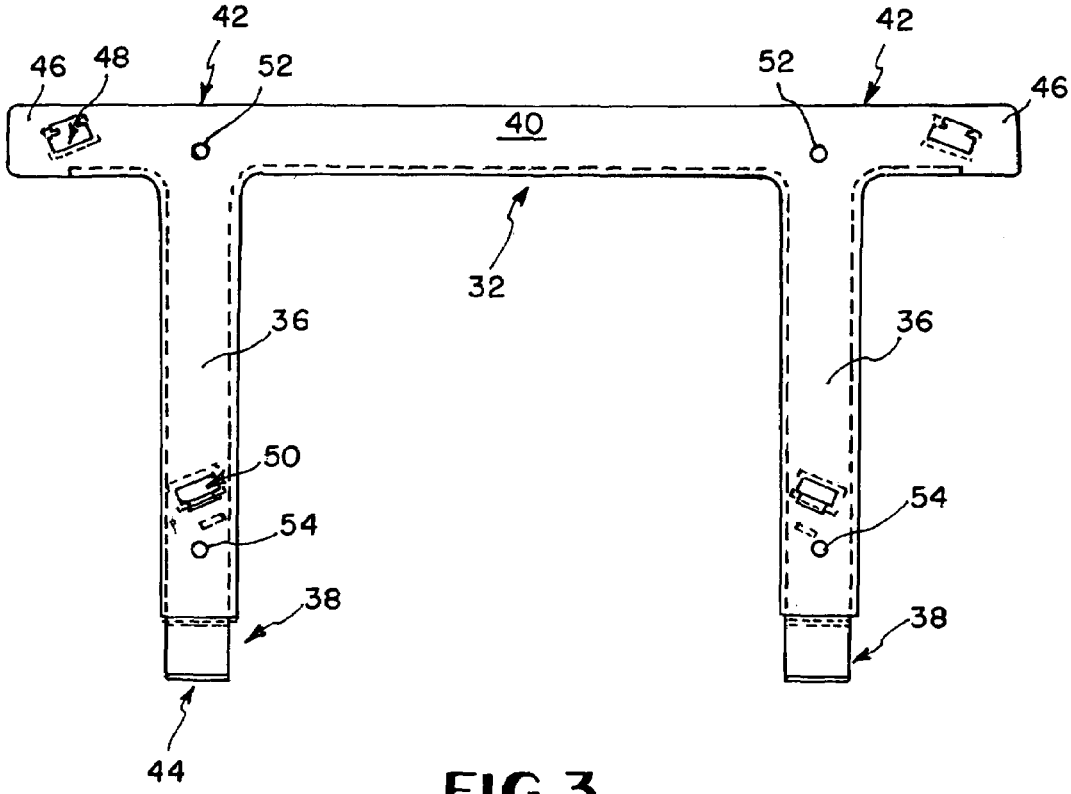
FIG. 3 is a front plan view of the display of FIG. 1.

FIG. 3 shows a front view of the frame 32 of the display 10 which is what would be shown in FIG. 2, except that sign 34 of the display 10 obscures the majority of the frame 32 from view. The frame 32 has legs 36 with feet 38 (shown in FIG. 4). The feet 38 cooperate with the leading edge 30 as will be described in relation to FIG. 4. Although two legs 36 and feet 38 are illustrated in the preferred embodiment, at least one foot 38 is necessary to connect to the leading edge 30. The sign 34 in FIG. 1 is disposed along the front to back length axis 11 of the vehicle (as well as in FIG. 2) and is at least substantially perpendicular to the axis 11 as well as at least substantially perpendicular to a road 17 supporting the vehicle as can be seen by examination of FIG. 2. The sign 34 is directed toward a rear of the vehicle. The sign 34 is preferably at least substantially planar and configured with a plurality of holes for receiving connectors 56 therethrough. The sign 34 of the preferred embodiment is akin to a license plate.

The legs 36 in the preferred embodiment meet at a span 40 which connects the legs 36 together. The span 40 of the preferred embodiment connects at top ends 42 of legs 36. Bottom ends 44 of legs 36 connects to feet 38. Cantilevered arms 46 extend from top ends 42 of legs 36. The arms 46 have first shaft connectors 48 connected thereto in the preferred embodiment. Legs 36 have second shaft connectors 50 connected thereto in the preferred embodiment. In the preferred embodiment, the arms 46 are collinear with span 40. The span 40 and arms 46 are perpendicular to legs 36. The frame also has upper sign retainers 52 and lower sign retainers 54. The upper sign retainers 54 are located on one of the arms 46, legs 36, or span 40. The lower sign retainers 54 are located below the upper sign retainers 52, and may be on similar structure, although in the preferred embodiment, location at a lower portion of legs 36 has been found to be advantageous. The sign retainers 52,54 are illustrated as holes in the frame 32 which receive connectors 56 such as bolts, screws or other known connection members as is known in the art. Connectors 56 are shown in FIGS. 1 and 2.

Figure 4:
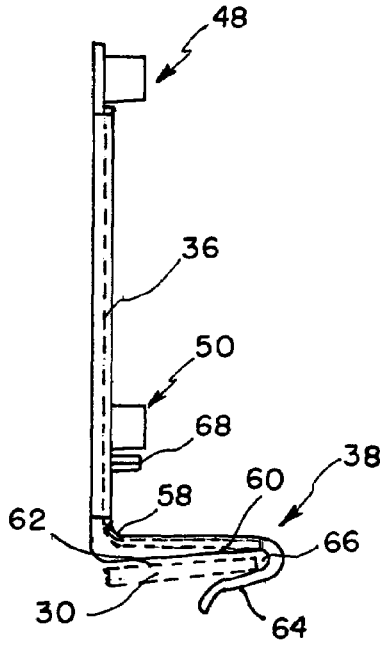
FIG. 4 is a side plan view of the display of FIG. 1.

FIG. 4 shows a side view of the frame 32. The leg 36 is shown having a reinforced ankle 58. The foot has a base 60 which rests atop one of the trunk 14 or hatchback 18. The leading edge 30 (of either the trunk 14 or hatchback 18) is shown in phantom in FIG. 4. the leading edge 30 has an upper surface 62 which preferably contacts the base 60 of the foot in the preferred embodiment. A toe 64 and the base 60 cooperate to form slot 66 which receives the leading edge therein. When the hatchback 18 or trunk 14 is opened, the leading edge 30 is accessible on most vehicles so that the slot 66 may be inserted over the leading edge 30.

FIG. 4 also shows the upper and lower shaft retainers 48,50. A stop 68 is shown which cooperates with bottom end 70 of a shaft 72, such as a flag pole as shown in FIG. 1. The sign 34 normally obscures the front of the frame 32 from view. The shaft 72 connects to an ornament such as a flag, shaker, etc. The ornament is disposed at least partially above the span 40.

Figure 5:
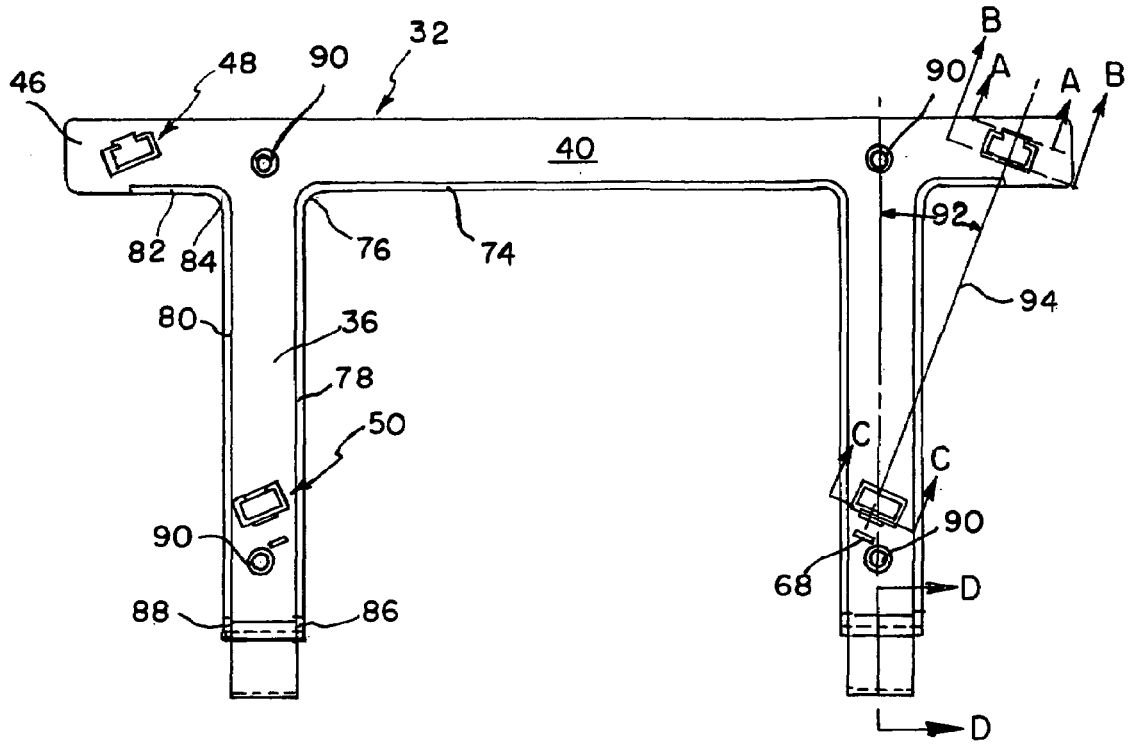
FIG. 5 is a back plan view of the display of FIG. 1.

FIG. 5 shows a back plan view of the frame 32. The span 40 has a supporting ridge 74 extending along its length. The ridge 74 meets at interior corner 76 and extends down interior edge 78 of the leg 36. Exterior edge 80 extends along the exterior side of the leg 36. The exterior edge 80 meets arm ridge 82 at exterior corner 84. The arm ridge 82 extends parallel and collinear to the supporting ridge 74. The interior and exterior corners 78,84 are preferably curved. The ridges 74,78,80,82 and corners 76,78 need not be provided in all embodiments, but have been found helpful to assist in providing strength to the frame 32.

The ankle 58 preferably has interior and exterior arches 86,88 which connect to and extend from the interior and exterior edges 78,80, respectively. The arches may provide additional support to the legs 36 especially when subjected to wind forces such as by highway driving.

Bolt sleeves 90 are useful to receive a bolt therein at upper and lower retainers 52,54 respectively. The sleeves 90 provide additional material to engage a bolt as shown in FIGS. 1 and 2, when such a connection mechanism is utilized.

FIG. 5 also shows the first and second shaft connectors 48,50. The first shaft connectors 48 are illustrated on the arms 46 in the preferred embodiment. Other placements may be possible in other embodiments. The second shaft connectors 50 are illustrated on the legs 36. Other placements may be possible in other embodiments. The first shaft connector is illustrated angled laterally relative to the leg 36 at twenty degrees in the preferred embodiment. While the angular relationship is fixed in the preferred embodiment, it could be adjustable in other embodiments. Furthermore, the angle 92 could be intermediate zero and ninety degrees, such as forty-five degrees, or thirty degrees, or the presently preferred twenty degrees.

The first shaft connector 48 is laterally spaced from the second shaft connector 50 in order to provide the angular relationship. The stop 68 is shown in FIG. 5 aligned along with a shaft axis 94. The stop 68 may be utilized to contact an inserted shaft 72 along the shaft axis 94. Details of the first and second shaft connectors 48,50 are shown in detail with reference to FIGS. 6–8.

Figure 6:
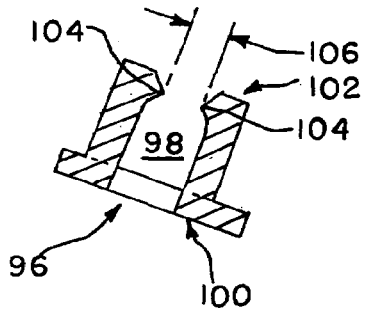
FIG. 6 is a cross sectional view taken along the line A—A of FIG. 5.

FIG. 6 shows a first, or an upper portion 96 of the fist shaft connector 48. The upper portion 96 has a passage 98 which preferably has a wider length toward the front portion 100 than toward a rear portion 102. By narrowing toward the rear of the upper portion of the connector 48, spurs 104 prevent an inserted shaft 72 of a sufficient width (or diameter) from coming out of the upper portion 96 once inserted. In fact, the spurs 104 may assist in locking the shaft 72 to the connector 48 as the force of the wind might push the shaft toward the rear portion 102 of the connector 48. The spurs 104 may contact one another in some embodiments, but in the preferred embodiment, they are resilient, and separated by a gap 106. A shaft 72 may be laterally inserted through the spurs 104, or slid along shaft axis 94 as shown in FIG. 5.

Figure 7:
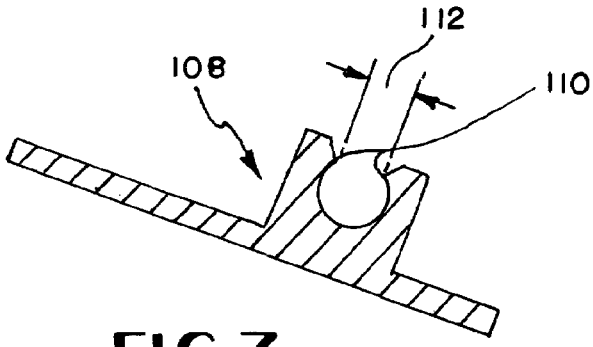
FIG. 7 is a cross sectional view taken along the line B—B of FIG. 5.
Figure 8:
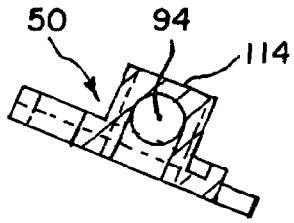
FIG. 8 is a cross sectional view taken along the line C—C of FIG. 5.

Although not necessary in all embodiments, a second portion 108 can be utilized with the upper connector 48 as shown in FIG. 7. This portion has projections 110 which also define a gap 112 which can allow lateral insertion of a shaft 72.

The lower shaft connector 50 may be similarly constructed as the upper shaft connector 48, or it may have a stay 114 which prevents rearward dislodgement of an inserted shaft 72 along shaft axis 94.

Figure 9:
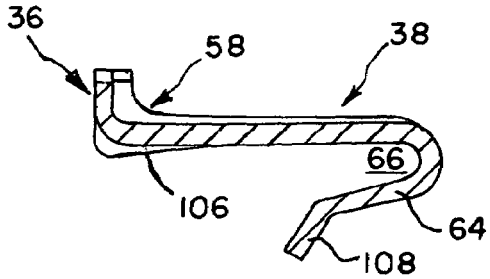
FIG. 9 is a cross sectional view taken along the line D—D of FIG. 5.

FIG. 9 shows the foot 38, ankle 58, and toe 64. One or more tracks 106 may be useful in providing additional support to the bottom of the ankle 58. Lip 108 may also be useful so that the slot 66 can be guided about a leading edge 30 as shown in FIG. 4.

Figure 10:
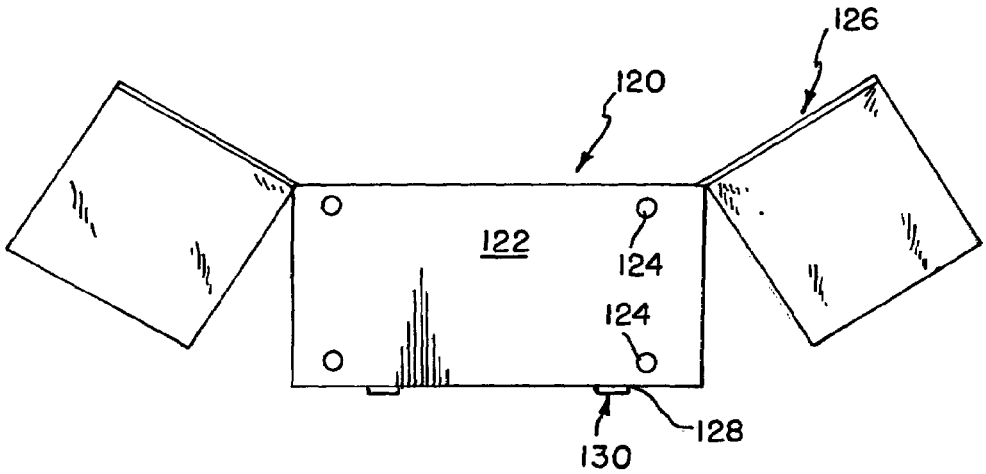
FIG. 10 is a front plan view of a first alternatively preferred embodiment.
Figure 11:
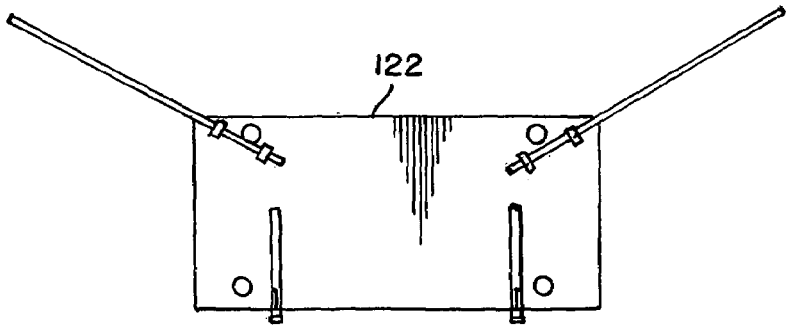
FIG. 11 is a back plan view of the first alternatively preferred embodiment.

FIGS. 1–9 show the presently preferred embodiment of the frame 32 used with a sign 34 and shafted members, such as flags 110 (shown in FIG. 1) or shakers 112 (shown in FIG. 2) forming the display 10. Alternative embodiments of display are also contemplated. FIG. 10 shows a first alternative display 120 having a sign panel 122. The sign panel 122 may include a visual display such as a license plate thereon, or it may be a support for a sign. Connectors 124 may be useful to connect a sign (not shown) to the sign panel 122. Flags 126 are illustrated extending at about 50 degrees relative to a vertical. The sign panel 122 may be clear, white or other color. Legs 128 may be equipped with pads 130 such as magnets and/or felt pads or pads constructed of other appropriate material FIG. 11 shows a back view of the alternative embodiment display 120 shown in FIG. 10. First and second shaft connectors 132, 134 are shown receiving the shafts 136, such as a flagpole, shaker stick, or other shaft. Legs 138 are shown connected to sign panel 122. The shaft connectors may have a bore which receives the shaft 136 there through. Set screws 138 on at least two sides of one of the shaft connectors 132, 134 retains the shaft to the connectors 132, 134. The legs 138 may be made of curved plate, or other appropriate material.

As can be seen from the differences of the display 10 and alternatively preferred display 120, the preferred display 10 has a frame 32 injection molded as a single piece. Much less fabrication is required. An appropriate material may be selected as is known in the art.

FIG. 12 shows a second alternatively preferred embodiment of a display 140. This display 140 has feet 142 which cooperate with a tailgate 144 of a truck 146.

FIG. 13 shows one method of forming feet 142 as shown in FIG. 12. The feet 142 preferably form a channel 148. The channel 148 may be adjustable in width such as by providing slots and connectors as would be understood by one skilled in the art referring to FIG. 13. Pads 150 may be used to provide support and assist in restraining the feet 142 to the tailgate 144. The sign panel 152 may be connected to the feet 142 in a similar manner as done for the first alternatively preferred embodiment as shown in FIGS. 10 and 11, or otherwise.

The shaft connectors are not shown in FIG. 13 and may not be necessary in all embodiments. Magnets and/or felt pads 150 may be useful in this design as well.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A removable display in combination with a vehicle having an access with a leading edge extending laterally relative to the vehicle, said leading edge selected from one of a top end of a hatchback, a forward end of a trunk, and a top of a tailgate; said display comprising:

a frame having a first leg connected to a first foot, said first foot having a base and a toe defining a slot, said slot received about said leading edge, said leg extending substantially perpendicular to the base;

a second foot connected to a second leg similarly constructed as the first foot and first leg respectively with the first and second legs connected by a span at top end of the first and second legs spaced from the feet;

first and second arms substantially collinear with the span and cantileveredly connected respectively to the first and second legs toward the top ends of the first and second legs with the arms substantially parallel to the span;

a sign connected to and supported by the frame substantially perpendicular to a front to back length axis of the vehicle, said sign directed towards the rear of the vehicle and is disposed at least substantially perpendicular to a road when the vehicle is on the road; and at least one shaft connector connected to the frame, said shaft connector configured to receive and retain a shaft to the frame.

2. The combination of claim 1 further comprising:

said shaft supporting an ornament at least partially above the span.

3. The combination of claim 1 wherein the slot has an adjustable width.

4. A display for use with a vehicle having an access with a leading edge selected from one of a top end of a hatchback, a forward end of a trunk, and a top of a tailgate, said display comprising:

a frame having spaced apart legs, feet and a span therebetween the legs meet the feet at ankles; and the ankles have arches, said arches extending above the base of the feet; and the arches continue as interior and exterior edges along the legs; and the exterior edges continue to arm ridges and the interior edges continue to a supporting ridge which joins the interior edges together along the span;

said feet connected to a bottom portion of each of the legs, each of said feet having a base and toes defining a slot therebetween, said slot configured to receive a leading edge of the access selected from one of a top end of a hatchback, a forward end of a trunk, and a top of a tailgate;

said span connecting the spaced apart legs together above the feet;

a sign connected to the frame and directed toward a rear of the vehicle at least substantially perpendicular to a road on which the vehicle is operating; and at least one shaft connector connected to one of the sign and the frame; and a shaft retained by the shaft connector, said shaft connected to an ornament.

5. The display of claim 4 wherein the ornament comprises one of a flag and a shaker.

6. The display of claim 4 wherein the frame extends substantially perpendicularly to the feet, and the sign is retained against the frame disposing the sign at least substantially perpendicularly to the feet.

7. The display of claim 4 wherein the slot is located forward of the legs.

8. The display of claim 4 further comprising first and second arms extending cantileveredly from a top end of the legs, said first and second arms extending collinearly with one another.

9. The display of claim 8 wherein the first and second arms extend at least substantially collinearly with the span.

* * * * *